US007619211B2

(12) United States Patent
Aikawa et al.

(10) Patent No.: US 7,619,211 B2
(45) Date of Patent: Nov. 17, 2009

(54) LIGHT GUIDING APPARATUS

(75) Inventors: Toshiharu Aikawa, Yokohama (JP); Kazuko Matsuoka, Yokohama (JP); Toshihiro Takahashi, Yokohama (JP)

(73) Assignee: Panasonic Corporation, Osaka (JP)

( * ) Notice: Subject to any disclaimer, the term of this patent is extended or adjusted under 35 U.S.C. 154(b) by 562 days.

(21) Appl. No.: 10/578,785

(22) PCT Filed: Dec. 15, 2004

(86) PCT No.: PCT/JP2004/018756

§ 371 (c)(1),
(2), (4) Date: May 9, 2006

(87) PCT Pub. No.: WO2005/059872

PCT Pub. Date: Jun. 30, 2005

(65) Prior Publication Data

US 2007/0147078 A1 Jun. 28, 2007

(30) Foreign Application Priority Data

Dec. 19, 2003 (JP) ..... 2003-423381

(51) Int. Cl.
*H01J 40/14* (2006.01)
*H01J 5/02* (2006.01)

(52) U.S. Cl. ..... 250/239; 250/227.11; 362/612

(58) Field of Classification Search ..... 250/239, 250/227.11; 362/612
See application file for complete search history.

(56) References Cited

U.S. PATENT DOCUMENTS 5,786,665 A * 7/1998 Ohtsuki et al. ..... 362/612
6,246,859 B1 * 6/2001 Takemura et al. ..... 250/239
6,410,908 B1 * 6/2002 Anderson et al. ..... 250/227.11
6,448,544 B1 * 9/2002 Stanton et al. ..... 250/239
6,476,379 B2 * 11/2002 Ando et al. ..... 250/227.11

FOREIGN PATENT DOCUMENTS

| | | | |
|---|---|---|---|
| JP | 58-117519 | U | 8/1983 |
| JP | 59-134178 | U | 9/1984 |
| JP | 60-191081 | U | 12/1985 |
| JP | 62-42092 | U | 3/1987 |
| JP | 2002-32149 | | 1/2002 |
| JP | 2002-149098 | A | 5/2002 |

OTHER PUBLICATIONS

Search Report for PCT/JP2004/018756.

* cited by examiner

*Primary Examiner*—Seung C Sohn
(74) *Attorney, Agent, or Firm*—Pearne & Gordon LLP

(57) ABSTRACT

LED elements (5) which are light emitting elements are mounted on a substrate (7). LED light guide plates (9, 9) which are light-emitting-element light guide components are arranged at positions corresponding to the LED elements (5) of the substrate (7). Each LED light guide plate (9) has a substrate-side protrusion (27) which is a portion to-be-held. The substrate-side protrusion (27) has a sectional shape which becomes smaller toward the substrate (7). The substrate-side protrusions (27) are fitted into the holding holes (37, 39) of a keeper plate (11) which is a holding member. The shapes of the holding holes (37, 39) are different in accordance with the arrangements of the LED light guide plates (9) in a light guide direction. Thus, in spite of the same shape of the LED light guide plates (9), the mounting heights thereof can be made different depending upon places. It is accordingly possible to provide a light emitting apparatus which can decrease the sorts of components.

8 Claims, 9 Drawing Sheets

LIGHT GUIDING APPARATUS

TECHNICAL FIELD

The present invention relates to a light emitting apparatus which can decrease the sorts of components.

BACKGROUND ART

A light emitting apparatus is, for example, an LED apparatus, which includes a light emitting element and a light-emitting-element light guide component for guiding light emitted by the light emitting element. In general, the light emitting element is an LED element, and the light-emitting-element light guide component is an LED light guide component. Such an LED apparatus is disclosed in, for example, JP-A-2002-32149 (pages 3-4, FIG. 6). The LED apparatus is installed in any of various electronic equipments, and the LED light guide component is disposed so as to guide the light to the window of a housing. The LED light guide component often has a plate-like shape, and such a component is also called "LED light guide plate".

FIG. 7 shows an example of a prior-art LED apparatus. In the illustrated example, a housing 101 is an operating panel, and it has a window 103 for projecting the light of an LED. The LED element 107 is mounted on a substrate 105.

An LED light guide plate 109 is made of a semitransparent resin, and it has a base portion 111, a window-side protrusion 113 which protrudes from the base portion 111 toward the housing 101, and a substrate-side protrusion 115 which protrudes from the base portion 111 toward the substrate 105. The window-side protrusion 113 and the substrate-side protrusion 115 are in the shape of plates. The base portion 111 is sandwiched in between a keeper plate 117 and the housing 101, whereby the LED light guide plate 109 is held. The window-side protrusion 113 is arranged in the window 103 of the housing 101. The substrate-side protrusion 115 is received in a hole 119 which is provided in the keeper plate 117.

Meanwhile, regarding the housing of the operating panel portion of an electronic equipment, there has recently increased a type which has a curved surface endowed with some curvature, unlike a single flat surface. A configurational example of an LED apparatus in this case is shown in FIG. 8.

Referring to FIG. 8, a housing 121 is a panel which is formed of a curved surface. Besides, windows 123, 125 differ in their heights to a panel front surface. In accordance with the difference of the heights to the panel front surface, therefore, a level difference is provided in the rear surface of the housing 121, and two sorts of LED light guide plates 127 and 129 having different heights are disposed. In the illustrated example, the base portion 133 of the LED light guide plate 129 is thicker than the base portion 131 of the LED light guide plate 127. Accordingly, the LED light guide plate 129 is higher than the LED light guide plate 127.

The above configuration is not restricted to the case where the housing has the curved surface. It is applicable to a case where the height of a housing differs depending upon places. Besides, in the prior art, the shapes of the LED light guide components are made different as stated above, whereby the positional relationship between the end surfaces of the LED light guide plates and the front surface of the housing is held.

The light emitting apparatus in the prior art, however, includes the plurality of sorts of light-emitting-element light guide components as stated above and is liable to rise in cost in correspondence with the more sorts of components. Moreover, since the plurality of components must be managed, the assembling job efficiency of the apparatus has been inferior.

DISCLOSURE OF THE INVENTION

Problems that the Invention is to Solve

The present invention has been made under the above background, and has for its object to provide a light emitting apparatus which can decrease the sorts of components.

Means for Solving the Problems

The light emitting apparatus of the present invention has a configuration comprising a substrate on which light emitting elements are mounted; a housing which has a front surface having different distances from the substrate; light-emitting-element light guide components which are arranged at positions corresponding to the light emitting elements, and each of which includes a portion to-be-held in a sectional shape becoming smaller toward the substrate; and a holding member which has holding holes adapted to fit the portions to-be-held thereinto, shapes of the holding holes being set so as to differ in accordance with the arrangements of the light-emitting-element light guide components in a light guide direction. The light emitting apparatus, the light emitting elements and the light-emitting-element light guide components are, for example, an LED apparatus, LED elements and LED light guide components, respectively.

As will be described later, other aspects exist in the invention. Accordingly, the disclosure of this invention is intended to provide some aspects of the invention, and it is not intended to limit the scope of the invention described and claimed here.

DESCRIPTION OF REFERENCE NUMERALS

Figure 1:
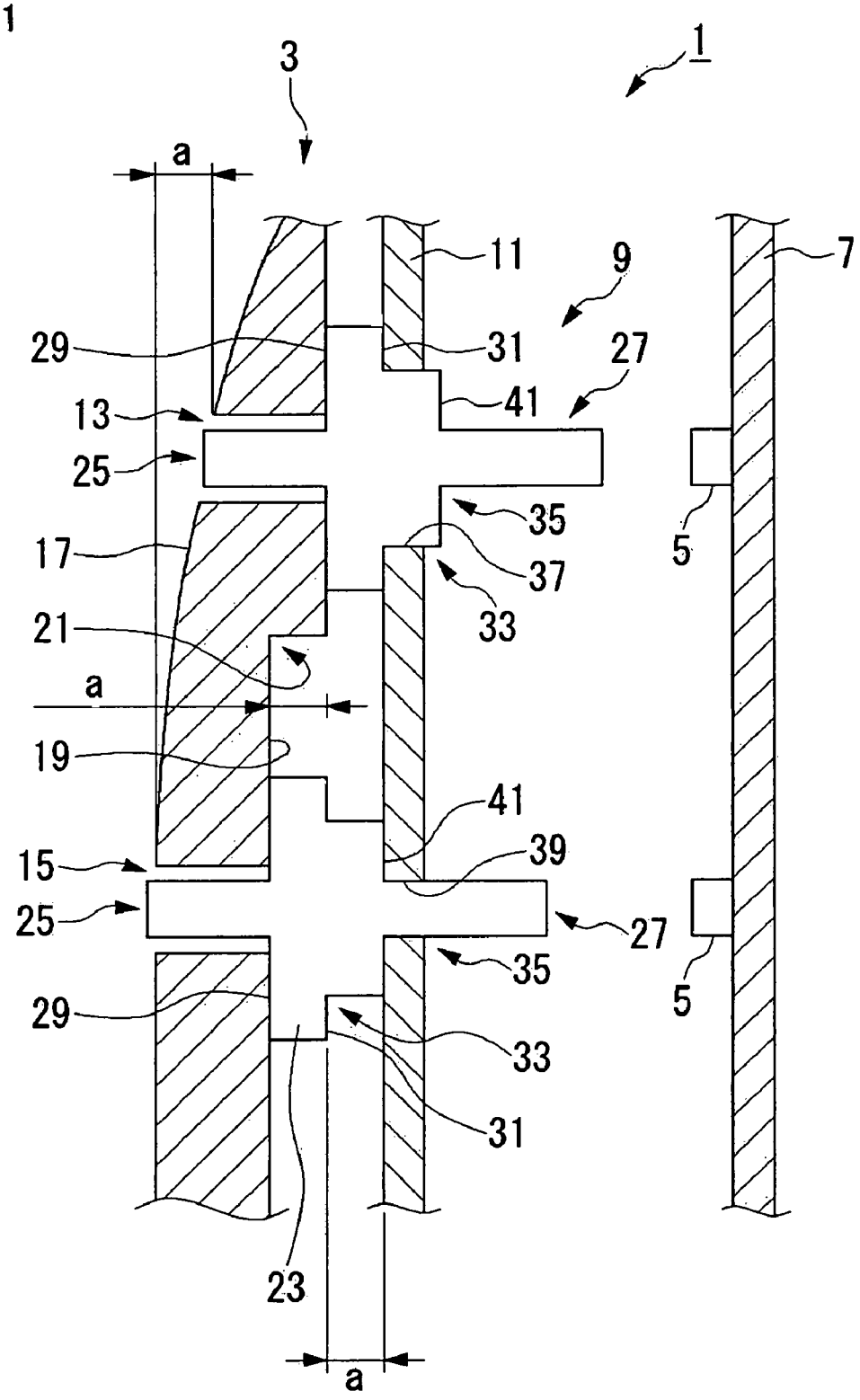
FIG. 1 is a sectional view of an LED apparatus in the first embodiment of the present invention.

1 LED apparatus
3 housing
5 LED element
7 substrate
9 LED light guide plate
11 keeper plate
13, 15 LED windows
23 base portion
25 window-side protrusion
27 substrate-side protrusion
33 first stage portion
35 second stage portion
37, 39 holding holes

BEST MODE FOR CARRYING OUT THE INVENTION

Now, the detailed description of the present invention will be made. The ensuing detailed description and the accompanying drawings, however, shall not restrict the invention. Instead, the scope of the invention shall be defined by the appended claims.

The present light emitting apparatus has a configuration comprising a substrate on which light emitting elements are mounted; a housing which has a front surface having different distances from the substrate; light-emitting-element light guide components which are arranged at positions corresponding to the light emitting elements, and each of which includes a portion to-be-held in a sectional shape becoming smaller toward the substrate; and a holding member which has holding holes adapted to fit the portions to-be-held thereinto, shapes of the holding holes being set so as to differ in accordance with the arrangements of the light-emitting-element light guide components in a light guide direction. The light emitting apparatus, the light emitting elements and the light-emitting-element light guide components are, for example, an LED apparatus, LED elements and LED light guide components, respectively.

Owing to this configuration, the shapes of the holding holes of the holding member are made different depending upon places, thereby the light-emitting-element light guide components are held by the holding member at the different positions of the portions to-be-held, whereby the positions of the light-emitting-element light guide components can be regulated and adjusted. Accordingly, in spite of the same shape of the light-emitting-element light guide components, the positions of these light-emitting-element light guide components in the light guide direction can be made different.

In the present light emitting apparatus, each of the portions to-be-held includes a plurality of stages, and that each of the holding holes has a size corresponding to any of the plurality of stages.

Owing to this configuration, the holding member can hold each portion to-be-held at any of the plurality of stages of the portion to-be-held and can reliably locate each portion to-be-held at the desired position of the plurality of stages.

Besides, in the present light emitting apparatus, each of the light-emitting-element light guide components includes a base portion, a first stage portion and a second stage portion whose sectional shapes become smaller toward the substrate, the first stage portion and the second stage portion are provided in the portion to-be-held, the holding member has a first holding hole which has a sectional dimension smaller than that of the base portion and larger than that of the first stage portion, and a second holding hole which has a sectional dimension smaller than that of the first stage portion and larger than that of the second stage portion, and the first stage portion fits into the first holding hole, while the second stage portion fits into the second holding hole.

Owing to this configuration, the positions of the light-emitting-element light guide components differ between on the occasions where the first stage portion fits into the first holding hole and where the second stage portion fits into the second holding hole. Accordingly, the positions of the light-emitting-element light guide components can be made different by the shapes of the holding holes.

Besides, in the present light emitting apparatus, each of the portions to-be-held includes a taper portion, and each of the holding holes has a shape in which it is held in touch with the taper portion when the light-emitting-element light guide component lies at a predetermined position.

Owing to this configuration, the portions to-be-held can be held at the desired positions of the taper portions. Accordingly, the versatility of setting the positions of the light-emitting-element light guide components can be increased.

Besides, in the present light emitting apparatus, each of the light-emitting-element light guide components includes a base portion, a first taper portion and a second taper portion whose sectional shapes become smaller toward the substrate, the first taper portion and the second taper portion are provided in the taper portion, the holding member has a first holding hole which has a sectional dimension smaller than that of the base portion and larger than that of the second taper portion, and a second holding hole which has a sectional dimension smaller than that of the first taper portion, and the first taper portion fits into the first holding hole, while the second taper portion fits into the second holding hole.

Owing to this configuration, the positions of the light-emitting-element light guide components differ between on the occasions where the first taper portion fits into the first holding hole and where the second taper portion fits into the second holding hole. Accordingly, the positions of the light-emitting-element light guide components can be made different by the shapes of the holding holes.

Besides, in the present light emitting apparatus, light emission quantities of the light emitting elements are set so as to differ in accordance with the arrangements of said light-emitting-element light guide components in the light guide direction. Owing to this configuration, the difference between light quantities which are projected through the light-emitting-element light guide components can be diminished.

Besides, in the present light emitting apparatus, the arrangements of the light emitting elements in the light guide direction are set so as to differ in accordance with the arrangements of the light-emitting-element light guide components in the light guide direction. Also owing to this configuration, the difference between light quantities which are projected through the light-emitting-element light guide components can be diminished.

As described above, in the present light emitting apparatus, each of the light-emitting-element light guide components is provided with the portion to-be-held whose sectional shape becomes smaller toward the substrate, and the holding member is provided with the holding holes whose shapes differ in accordance with the arrangements of the light-emitting-element light guide components. Thus, the sorts of the light-emitting-element light guide components can be decreased, curtailment in cost can be attained by the decrease of the sorts, and an assembling job can be facilitated.

Hereafter, light emitting apparatuses in the embodiments of the present invention will be described with reference to the drawings. In each of the embodiments, as stated below, the light emitting apparatus is an LED apparatus, and light emitting elements are LED elements. Besides, light-emitting-element light guide components are LED light guide components, more particularly LED light guide plates.

FIG. 1 shows an LED apparatus in the first embodiment of the invention. Referring to FIG. 1, the LED apparatus 1 has a housing 3, a substrate 7 on which LED elements 5 being light emitting elements are mounted, LED light guide plates 9 which guide light beams emitted by the LED elements 5, and a keeper plate 11 which holds the LED light guide plates 9. The LED light guide plates 9 are held in a state where they are interposed between the housing 3 and the keeper plate 11. The LED light guide plates 9 and the keeper plate 11 correspond to light-emitting-element light guide components and a holding member in the invention, respectively.

The housing 3 is made of a resin, and it is provided with two LED windows 13, 15 as shown in the figure. The front surface 17 of the housing 3 is formed of a curved surface, so that the heights of the front surface 17 of the housing 3 in the LED windows 13, 15 are different.

By the way, in the ensuing description, the "heights of the front surface 17 of the housing 3, etc." shall signify heights in a light guide direction, and the "light guide direction" shall signify a direction in which the LED light guide plates 9 guide the light. In the example of FIG. 1, the light guide direction is a direction from the substrate 7 toward the LED windows 13, 15.

The rear surface 19 of the housing 3 is provided with a level difference 21, and the height a of the level difference 21 is equal to the difference between the heights of the front surface 17 in the LED windows 13, 15 as shown in the figure. Thus, the heights of the rear side of the housing 3 change at the positions of the LED windows 13, 15, and the housing 3 has substantially equal thicknesses at the positions of the LED windows 13, 15.

The LED light guide plates 9 are made of a semitransparent resin, and the two LED light guide plates 9 are the same components. Each of the LED light guide plates 9 has a base portion 23, a window-side protrusion 25 and a substrate-side protrusion 27. The window-side protrusion 25 and the substrate-side protrusion 27 are in the shape of plates.

The window-side protrusion 25 protrudes from the end surface 29 of the base portion 23 on the side of the housing 3, toward the housing 3, and it has a shape in which it fits into the corresponding LED window 13 or 15 of the housing 3. Besides, the end surface 29 lies in touch with the rear surface 19 of the housing 3.

On the other hand, the substrate-side protrusion 27 protrudes from the end surface 31 of the base portion 23 on the side of the substrate, toward the substrate 7. The substrate-side protrusion 27 corresponds to a portion to-be-held in the invention, and the sectional shape of the substrate-side protrusion 27 becomes smaller toward the substrate 7 as the feature of this embodiment. In this embodiment, the substrate-side protrusion 27 becomes finer in stages, and it is constructed of a first stage portion 33 and a second stage portion 35. The sectional shape of the first stage portion 33 is smaller than that of the base portion 23. Besides, the height of the first stage portion 33 is set to be equal to the difference a between the exit heights of the LED windows 13 and 15, and it is accordingly equal to the height of the level difference 21 lying at the rear surface 19 of the housing 3.

Next, the keeper plate 11 is made of a steel plate, and it has holding holes 37, 39 at positions corresponding to the two LED elements 5.

The holding hole 37 has a size which corresponds to the first stage portion 33 of the substrate-side protrusion 27 of the LED light guide plate 9. The sectional dimension of the holding hole 37 is larger than that of the first stage portion 33 to the extent that a small gap is defined between this holding hole and the first stage portion 33, and it is smaller than the sectional dimension of the base portion 23. Thus, in the holding hole 37, the LED light guide plate 9 fits into this holding hole 37, up to the first stage portion 33 of the substrate-side protrusion 27, and the keeper plate 9 abuts on the end surface 31 of the base portion 23.

In contrast, the holding hole 39 has a size which is smaller than the sectional dimension of the holding hole 37, and which corresponds to the second stage portion 35. The sectional dimension of the holding hole 39 is larger than that of the second stage portion 35 to the extent that a small gap is defined between this holding hole and the second stage portion 35, and it is smaller than the sectional dimension of the first stage portion 33. Accordingly, in the holding hole 39, the LED light guide plate 9 fits into this holding hole 39, only up to the second stage portion 35, and the keeper plate 9 abuts on the end surface 41 of the first stage portion 33.

Incidentally, the "sectional dimension(s)" mentioned above is (are) a dimension(s) which represent the sizes of the sectional shapes of the various constituents such as the base portions 23, first stage portions 33, second stage portions 35, and holding holes 37, 39, and more particularly, dimension(s) in a direction crossing the insertion direction of the LED light guide plates 9. In the above example, the holding holes 37, 39, etc. are rectangular, and the sectional dimension is the length of the latera of rectangles (widths, etc.). Besides, if the holding holes 37, 39, etc. are circular, the sectional dimension is diameter, and if they are elliptic, the sectional dimension is the dimension of major axes or minor axes. Insofar as the fitting relationships between the holding holes and the members to be fitted into these holding holes are represented, the sectional dimension may be a dimension of any desired sorts.

Owing to the above settings of the sectional dimension, when the LED window 15 for which the holding hole 39 is provided is compared with the LED window 13 for which the holding hole 37 is provided, the LED light guide plate 9 fits into the keeper plate 11 more shallowly and lies at a position remoter from the substrate 7 in the LED window 15. Besides, the LED light guide plate 9 of the LED window 15 lies at a position remoter from the substrate 7 than the LED light guide plate 9 of the LED window 13. The difference of the positions is equal to the distance a which corresponds to the height of the first stage portion 33. On the other hand, the heights of the exits of the LED windows 15 and 13 are different by the distance a. In the LED windows 13 and 15, accordingly, the positional relationships between the end parts of the LED light guide plates 9 and the window exits in the height direction are substantially the same.

Besides, in this embodiment, the light emission quantities of the LED elements 5 are set so as to differ in accordance with the arrangements of the LED light guide plates 9. As the LED light guide plate 9 lies in front more in the light guide direction, that is, as it is remoter from the substrate 7, the light emission quantity of the LED element 5 is set larger. In the example of FIG. 1, the light emission quantity of the LED element 5 disposed for the LED window 15 is set larger than that of the LED element 5 disposed for the LED window 13. Besides, the light emission quantities of the LED elements 5 are set so that light reception quantities at the end surfaces of the substrate-side protrusions 27 of the LED light guide plates 9 may become substantially equal for the LED windows 13 and 15. Thus, also light projection quantities from the window-side protrusions 25 become substantially equal for the LED windows 13 and 15.

Incidentally, as a modification to this embodiment, instead of changing the light emission quantities of the LED elements 5, the positions of the LED elements 5 may be made different so as to equalize the distances between the LED elements 5 and the LED light guide plates 9 for the LED windows 13 and 15. Besides, the distances between the LED elements 5 and the LED light guide plates 9 may be equalized for the LED windows 13 and 15 by changing the heights of the LED elements 5 themselves. Even with this configuration, the light projection quantities can be equalized though the positions of the LED light guide plates 9 are different.

Next, there will be described an example of the assembling sequence of the above LED apparatus 1. The window-side protrusions 25 of the two LED light guide plates 9 are respectively fitted into the LED windows 13 and 15 of the housing 3. Besides, the keeper plate 11 is attached to the housing 3 from the rear side of this housing. On this occasion, the substrate-side protrusions 27 of the LED light guide plates 9 are respectively fitted into the holding holes 37 and 39 of the keeper plate 11. In the holding hole 37, the substrate-side protrusion 27 fits into this holding hole 37 up to the first stage portion 33, and in the holding hole 39, the substrate-side protrusion 29 fits into this holding hole 39 up to the second stage portion 35, whereby the two LED light guide plates 9 are incorporated at the different heights. Besides, the housing 3 is attached to that body of an electronic equipment on which the substrate 7 is mounted. On this occasion, the housing 3 is arranged so that the LED light guide plates 9 may oppose to the LED elements 5.

In the first embodiment thus far described, as stated before, the LED light guide plates 9 correspond to the light-emitting-element light guide components, the keeper plate 11 to the holding member, and the substrate-side protrusions 27 of the LED light guide plates 9 to the portions to-be-held. Besides, each of the light-emitting-element light guide components is provided with the portion to-be-held whose sectional shape becomes smaller toward the substrate, and the holding member is provided with the holding holes whose shapes are different in accordance with the arrangements of the light-emitting-element light guide components. Owing to such a configuration, the light-emitting-element light guide components of the same shape are held by the holding member at the positions of the portions to-be-held as differ depending upon the places. Accordingly, notwithstanding that the light-emitting-element light guide components are in the same shape, the heights of the mounting positions can be altered and adjusted, whereby the sorts of the components can be decreased. Owing to the decrease of the sorts of the components, curtailment in cost can be attained, and reduction in the number of man-hour of the job is permitted.

Moreover, in the light emitting apparatus of this embodiment, each portion to-be-held is provided with the plurality of stages, and the size of each holding hole is caused to correspond to any of the plurality of stages. Thus, the holding member can hold the portion to-be-held at any of the plurality of stages of this portion to-be-held and can reliably locate the portion to-be-held at any desired position of the plurality of stages.

Moreover, in the light emitting apparatus of this embodiment, each of the light-emitting-element light guide components is provided with the base portion, the first stage portion and the second stage portion, while the holding member is provided with the first holding hole which is smaller than the sectional dimension of the base portion and which is larger than the sectional dimension of the first stage portion, and the second holding hole which is smaller than the sectional dimension of the first stage portion and which is larger than the sectional dimension of the second stage portion. Thus, the positions of the light-emitting-element light guide components differ between on the occasions where the first stage portion fits into the first holding hole and where the second stage portion fits into the second holding hole. Accordingly, the positions of the light-emitting-element light guide components can be made different by the shapes of the holding holes.

Moreover, in the light emitting apparatus of this embodiment, the light emission quantities of the light emitting elements are set to be different in accordance with the arrangements of the light-emitting-element light guide components in the light guide direction, whereby the difference between the light quantities which are projected through the light-emitting-element light guide components can be diminished.

Moreover, in the light emitting apparatus of this embodiment, the arrangements of the light emitting elements in the light guide direction are set to be different in accordance with the arrangements of the light-emitting-element light guide components in the light guide direction, whereby the difference between the light quantities which are projected through the light-emitting-element light guide components can be diminished.

FIGS. 2-5 show an LED apparatus in the second embodiment of the invention. Hereafter, items described in conjunction with FIG. 1 shall be omitted on occasion.

Figure 2:
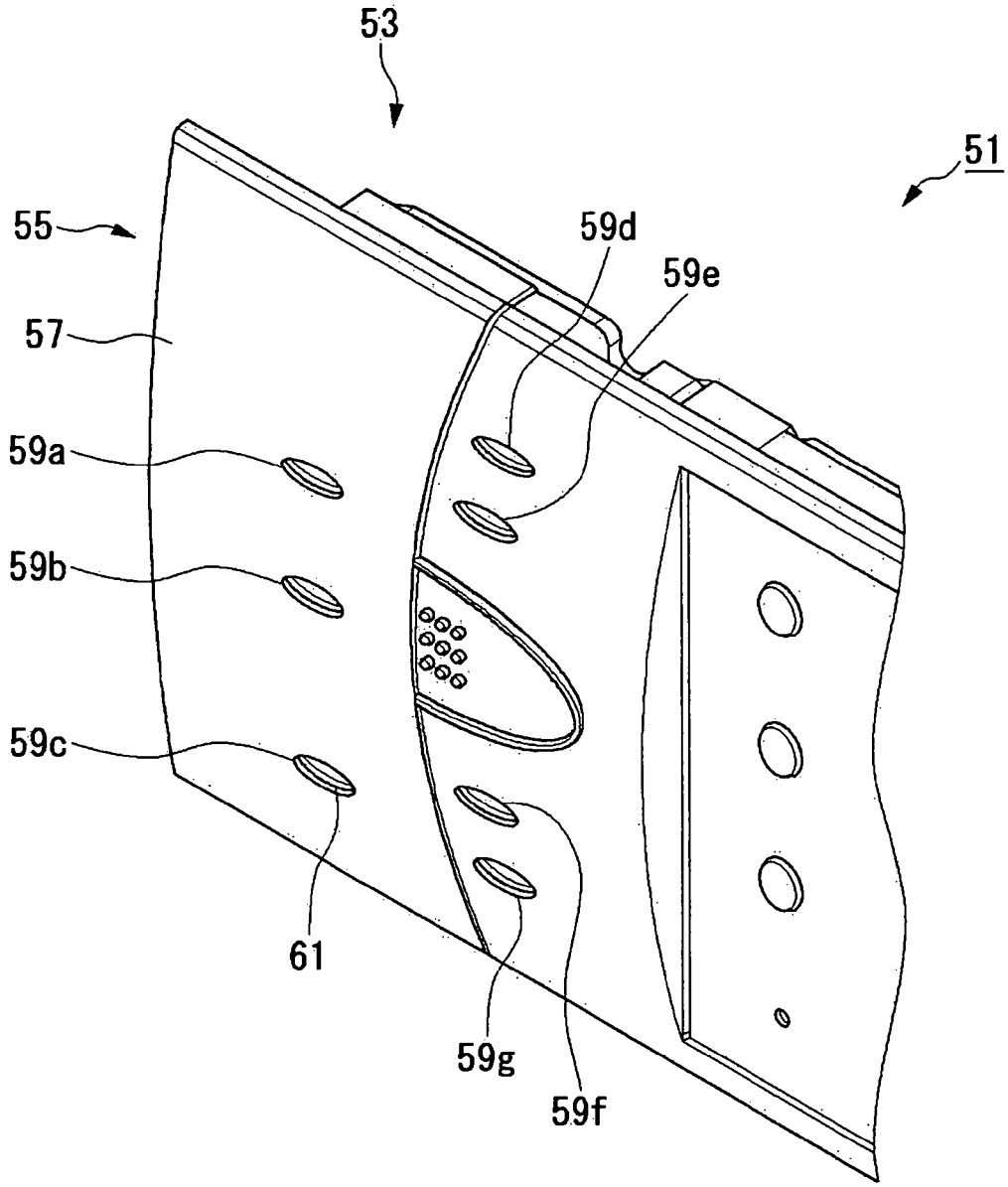
FIG. 2 is a perspective view of an LED apparatus in the second embodiment of the invention.

FIG. 2 is a perspective view of the external appearance, in which an electronic equipment 51 includes an LED apparatus 53, and an operating panel 55 forms part of the housing of the electronic equipment 51. Seven LED windows 59*a*-59*g* are provided in the front surface 57 of the operating panel 55, and each of these LED windows 59*a*-59*g* is substantially elliptic and penetrates through the operating panel 55. Since the front surface 57 of the operating panel 55 is formed of a curved surface, the height of the front surface 57 differs depending upon the positions of the LED windows 59*a*-59*g*. The end parts of LED light guide plates 61 are seen from the LED windows 59*a*-59*g*.

Figure 3A:
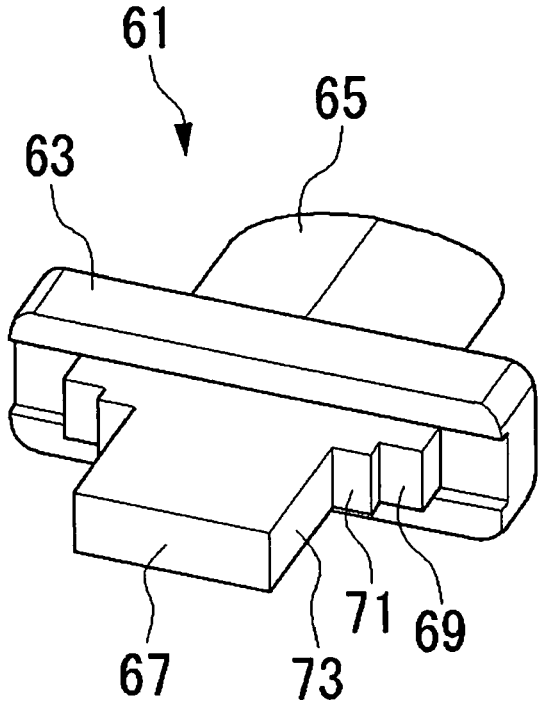
FIG. 3A is a perspective view of an LED light guide plate in the second embodiment of the invention.
Figure 3B:
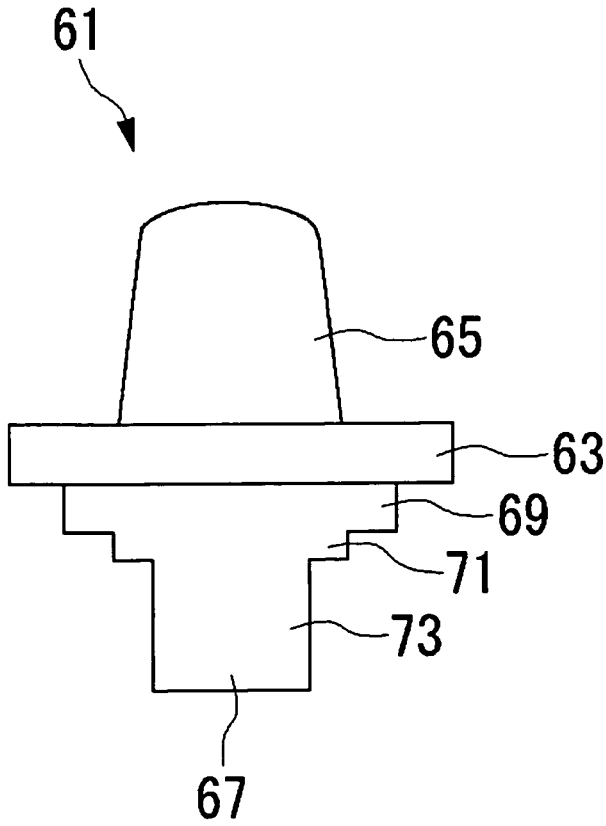
FIG. 3B is a front view of the LED light guide plate in the second embodiment of the invention.
Figure 3C:
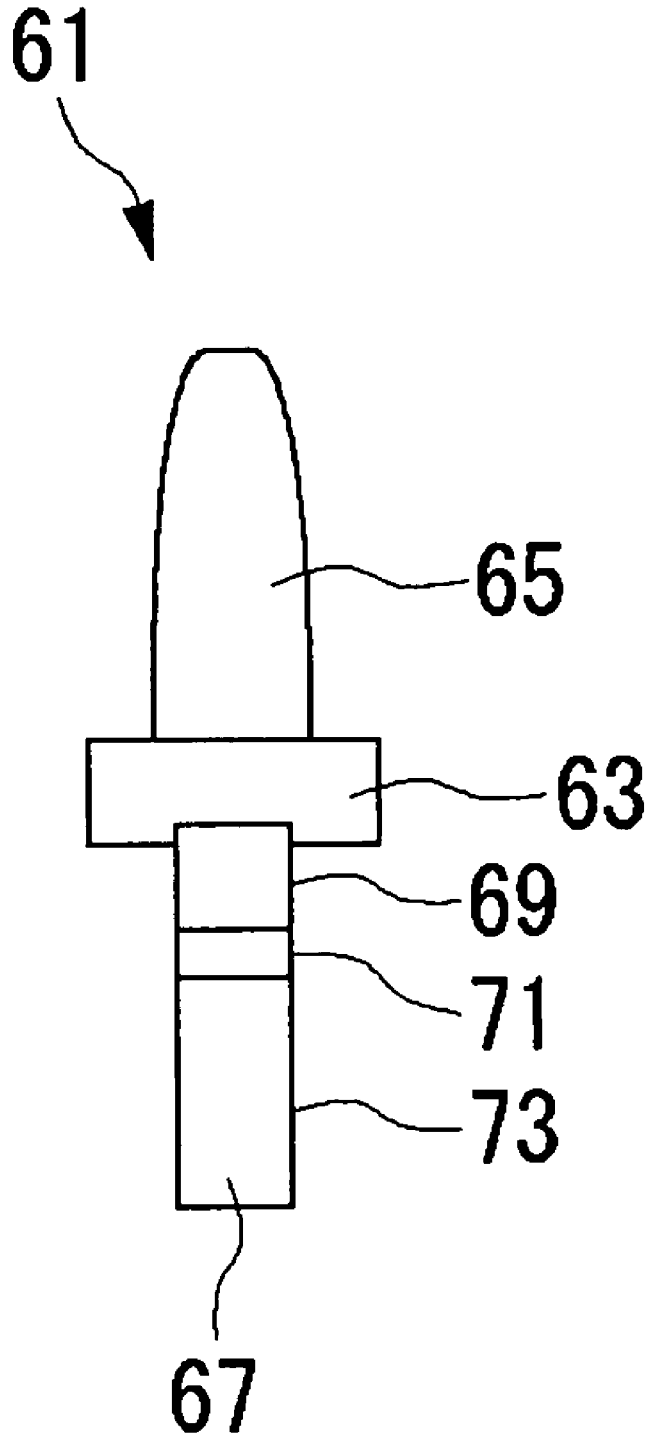
FIG. 3C is a side view of the LED light guide plate in the second embodiment of the invention.

FIGS. 3A, 3B and 3C show the LED light guide plate 61. FIG. 3A is a perspective view, FIG. 3B is a front view, and FIG. 3C is a side view. The LED light guide plate 61 has a window-side protrusion 65 and a substrate-side protrusion 67 on both the sides of a base portion 63. The substrate-side protrusion 67 corresponds to a portion to-be-held.

The substrate-side protrusion 67 becomes finer in two stages stepwise. More specifically, the substrate-side protrusion 67 has a first stage portion 69, a second stage portion 71 and a third stage portion 73 from its root toward its distal end as shown in the figures. Besides, sectional shapes become smaller in the order of the base portion 23, first stage portion 69, second stage portion 71 and third stage portion 73.

Figure 4:
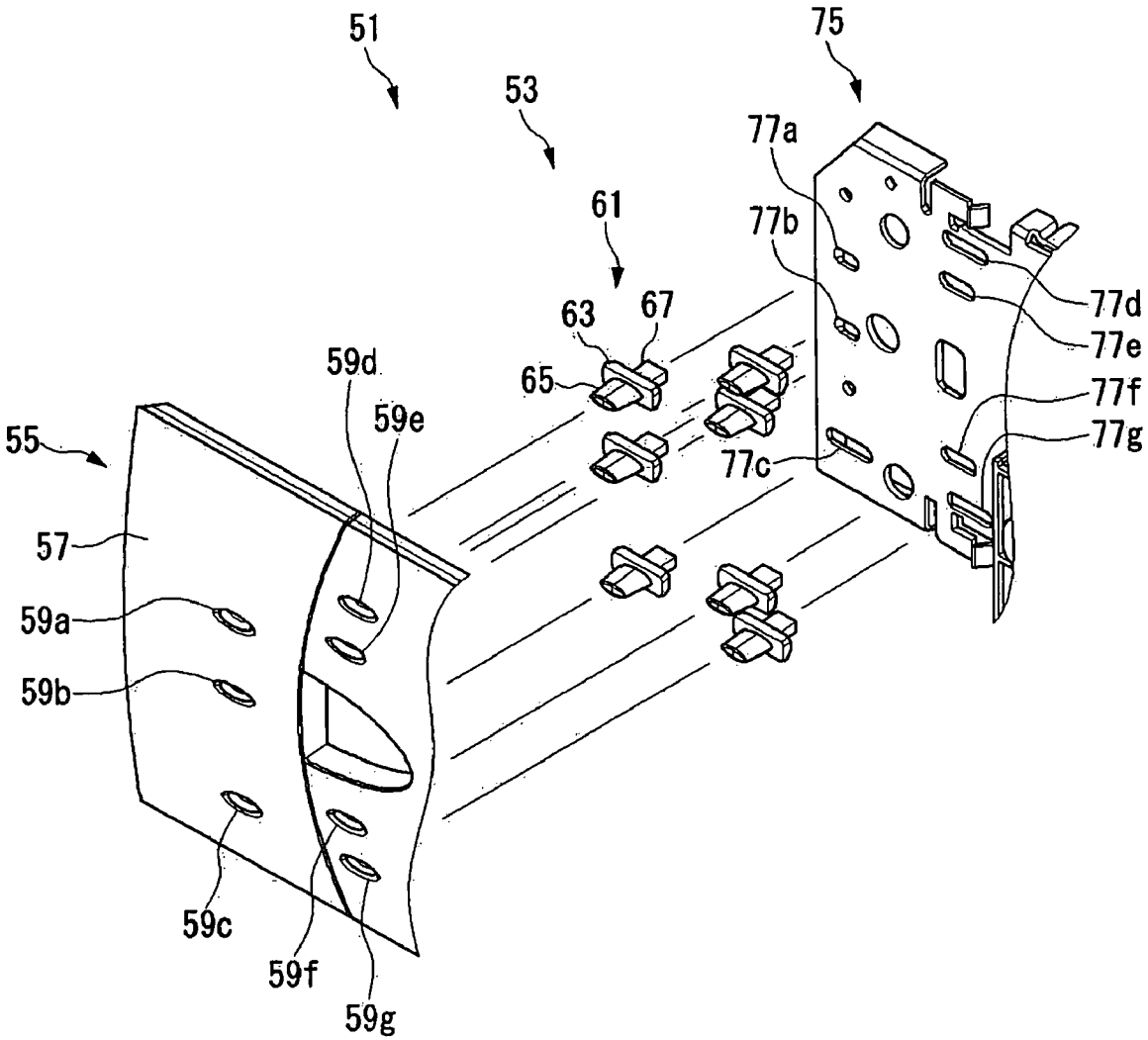
FIG. 4 is an exploded assemblage view of the LED apparatus in the second embodiment of the invention.

FIG. 4 is an exploded assemblage view of the LED apparatus 53. The seven LED light guide plates 61 are incorporated into the LED apparatus 53. These seven LED light guide plates 61 are the same components. The window-side protrusions 65 of the LED light guide plates 61 are fitted into the respective LED windows 59*a*-59*g* of the operating panel 55, while the substrate-side protrusions 67 are fitted into the respective holding holes 77*a*-77*g* of a keeper plate 75.

As shown in the figure, the holding holes 77*a*-77*g* have three sorts of sizes. The holding holes 77*a*, 77*b* are small, the holding holes 77*e*, 77*f* have the medium size, and the holding holes 77*c*, 77*d*, 77*g* are the largest. The size of the holding holes 77*a*, 77*b* corresponds to the third stage portions 73 of the substrate-side protrusions 67 of the LED light guide plates 61, the holding holes 77*e*, 77*f* to the second stage portions 71, and the holding holes 77*c*, 77*d*, 77*g* to the first stage portions 69.

When note is taken of, for example, the holding holes 77*c*, 77*d*, 77*e*, the sectional dimensions of the holding holes 77*c*, 77*d*, 77*e* are set to be larger than those of the first stage portions 69 to the extent of defining small gaps between these holding holes and the first stage portions 69, and to be smaller than those of the base portions 63. The sectional dimensions of the other holding holes are similar, and are set to be somewhat larger than those of the corresponding stage portions. Incidentally, as described in the first embodiment, the sectional dimensions mentioned above are the dimensions of the holding holes, etc. in a direction which crosses the direction of inserting the light guide members into these holding holes, and they represent the relationships of sizes concerning the fitting engagements of the holding holes, etc.

Owing to the above settings, the LED light guide plates 61 fit into the holding holes 77*a*, 77*b* up to the third stage portions 73, and the end surfaces of the second stage portions 71 lie in touch with the keeper plate 75. Besides, the LED light guide plates 61 fit into the holding holes 77*e*, 77*f* up to the second stage portions 71, and the end surfaces of the first stage portions 69 lie in touch with the keeper plate 75. Further, the LED light guide plates 61 fit into the holding holes 77*c*, 77*d*, 77*g* up to the first stage portions 69 and the end surfaces of the base portions 63 lie in touch with the keeper plate 75.

Figure 5:
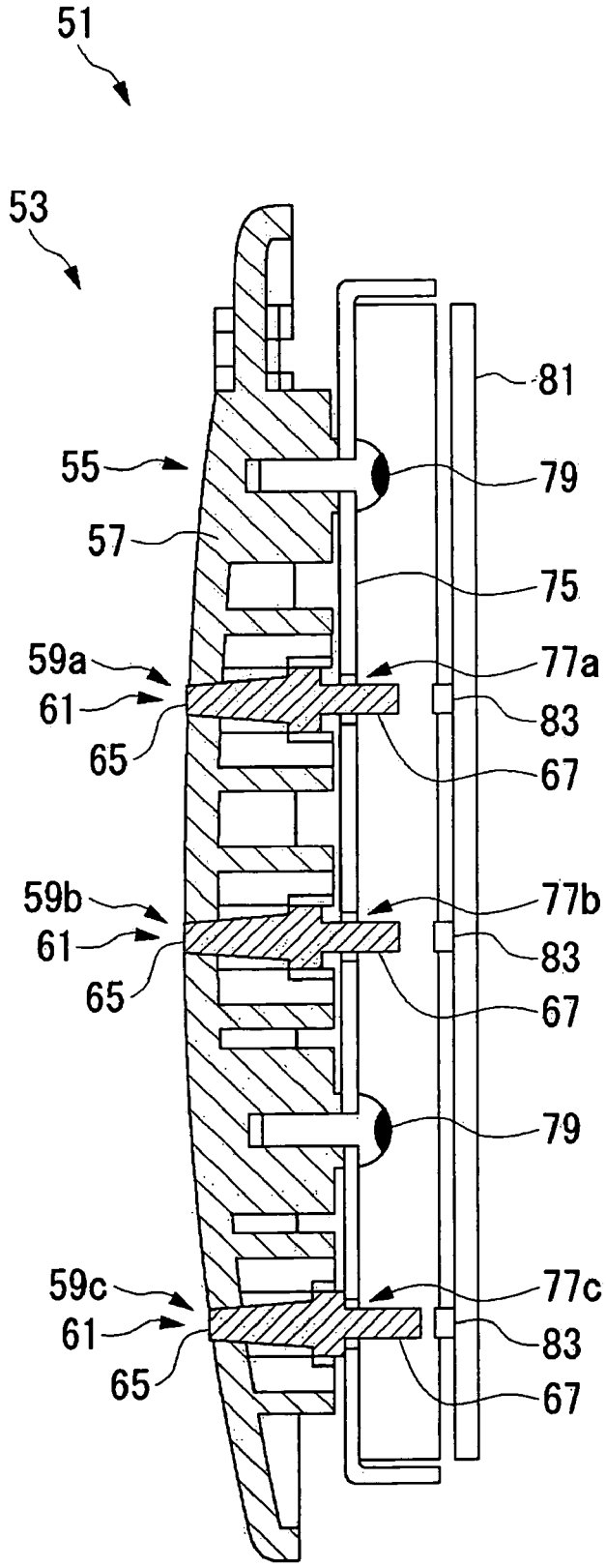
FIG. 5 is a sectional view of the LED apparatus in the second embodiment of the invention.

FIG. 5 is a sectional view in which the LED apparatus 5 in FIG. 2 is sectioned along line A-A passing through the LED windows 59*a*, 59*b* and 59*c*. The keeper plate 65 is attached to the operating panel 55 by screws 79. A substrate 81 lies behind the keeper plate 65. LED elements 83 are mounted on the substrate 81, and the LED elements 83 and the LED light guide plates 61 confront each other, respectively.

Besides, as shown in the figure, in the LED windows 59*a* and 59*b*, the substrate-side protrusions 67 of the LED light guide plates 61 fit into the keeper plate 65 up to only the intermediate parts thereof. In contrast, in the LED window 59*c*, the substrate-side protrusion 67 fits into the keeper plate 65 up to the root thereof. Although not shown in the sectional direction of FIG. 5, the substrate-side protrusions 67 fit up to only the third stage portions in correspondence with the LED windows 59*a* and 59*c*, whereas the substrate-side protrusion 67 fits up to the first stage portion in correspondence with the LED window 59*c*. As a result, the LED light guide plates 61 are located remoter from the substrate 81 in the places where the LED windows 59*a* and 59*b* lie, than in the place where the LED window 59*c* lies.

Here, with note taken of the front surface 57 of the operating panel 55, this front surface 57 is the curved surface. Besides, the front surface 57 of the operating panel 55 is higher in the places where the LED windows 59*a* and 59*b* lie, than in the place where the LED window 59*c* lies. Accordingly, the LED windows 59*a* and 59*b* and the LED window 59*c* are different in the heights of their exits. The heights of the window exits and the mounting heights of the light guide plates differ equally in both the two sorts of places. As a result, the positional relationships between the end parts of the light guide plates and the window exits become substantially the same in the LED windows 59*a*-59*c*.

The same holds true also of the LED windows 59*d*-59*g* in FIG. 4 though these LED windows are not shown in FIG. 5. In the LED windows 59*d* and 59*g*, the LED light guide plates 61 are located at the same height as in the LED window 59*c* in FIG. 5. Besides, in the LED windows 59*e* and 59*f*, the LED light guide plates 61 fit into the keeper plate 65 up to the second stage portions, and hence, these LED light guide plates 61 are located at an intermediate height. Owing to such mounting, the positional relationships between the end parts of the light guide plates and the window exits become the same in the seven LED windows 59*a*-59*g*.

As thus far described, also in the second embodiment, notwithstanding that the LED light guide components are in the same shape, the positions of the light guide components in the light guide direction can be made different, the sorts of the components can be decreased, and curtailment in cost and reduction in the number of man-hour of the job are permitted.

Moreover, in this embodiment, the number of stages of each portion to-be-held is increased, whereby the arrangements of the LED light guide components can be adjusted in three stages, to increase the versatility of the arrangements. It is a matter of course that the number of stages of each portion to-be-held may well be further increased.

Besides, within the scope of the invention, the holding holes may well have geometries which correspond to the portions to-be-held being subjects for reception, at parts of the circumferences of the portions to-be-held. In the above example, the gap between each holding hole and the corresponding substrate-side protrusion need not be small over the whole circumference of the substrate-side protrusion. By way of example, the gap may be small in only the long latus direction of an oblong.

Besides, within the scope of the invention, the sectional shape of each portion to-be-held need not be the oblong, but it may well be, for example, a circle, an ellipse or any other polygon. The section need not be constant, either. It may well be, for example, circular on the root side and square at the distal end.

Figure 6:
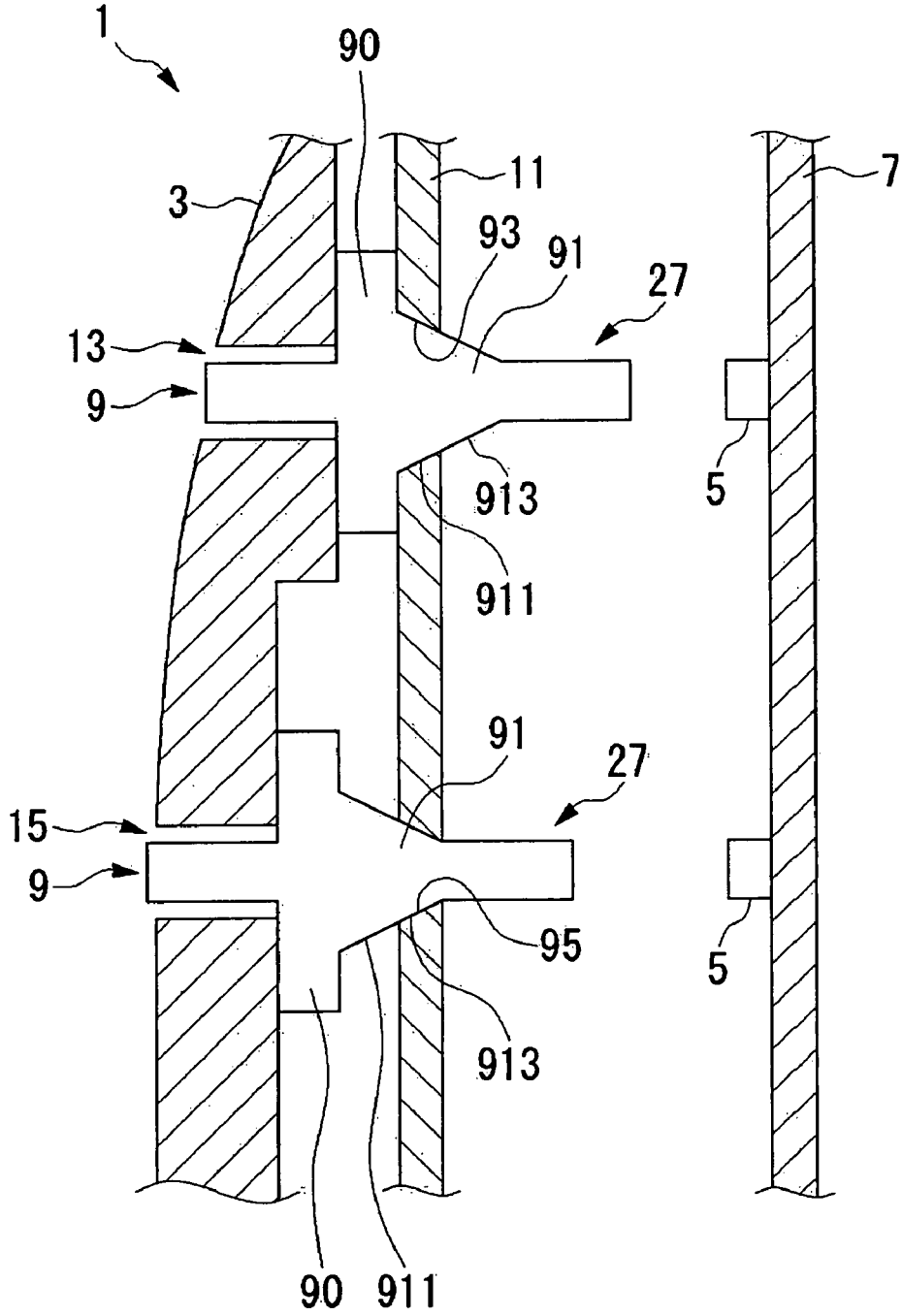
FIG. 6 is a sectional view of an LED apparatus in the third embodiment of the invention.
Figure 7:
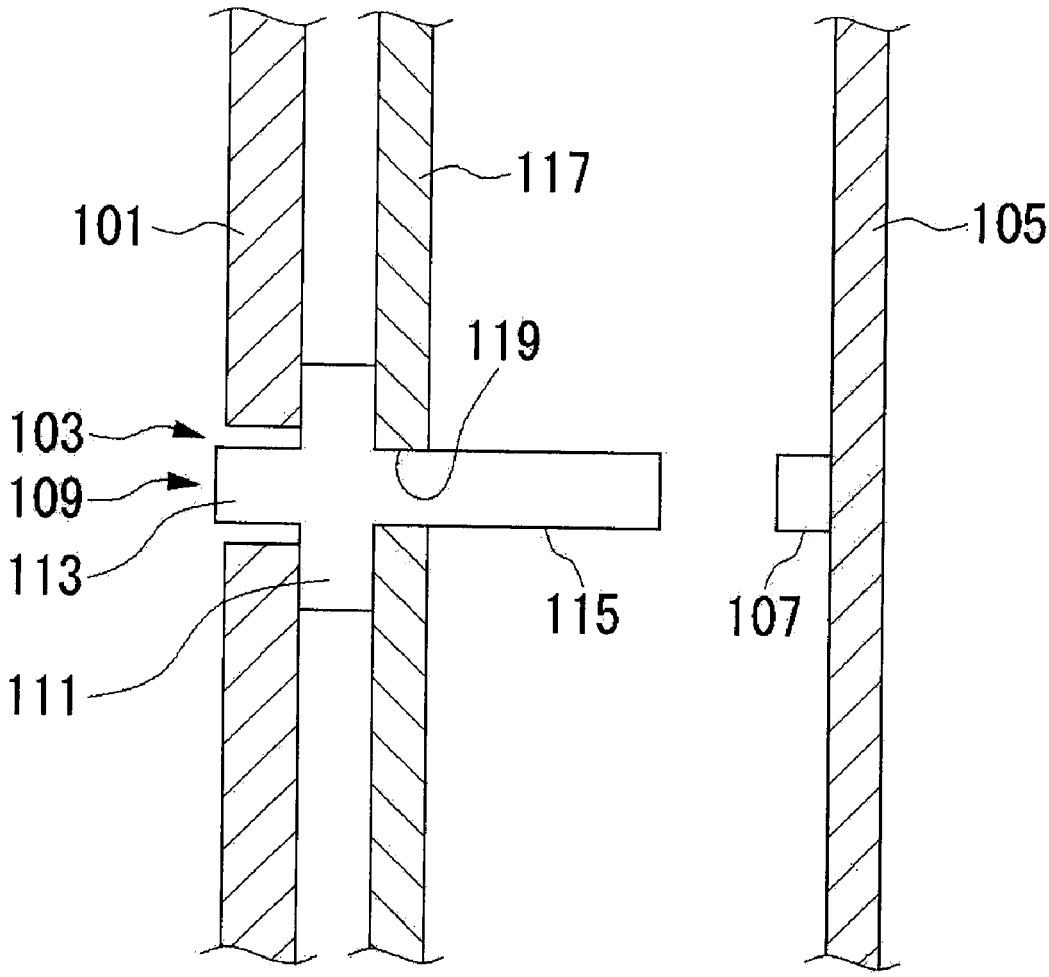
FIG. 7 PRIOR ART
FIG. 7 is a sectional view of a prior-art LED apparatus.
Figure 8:
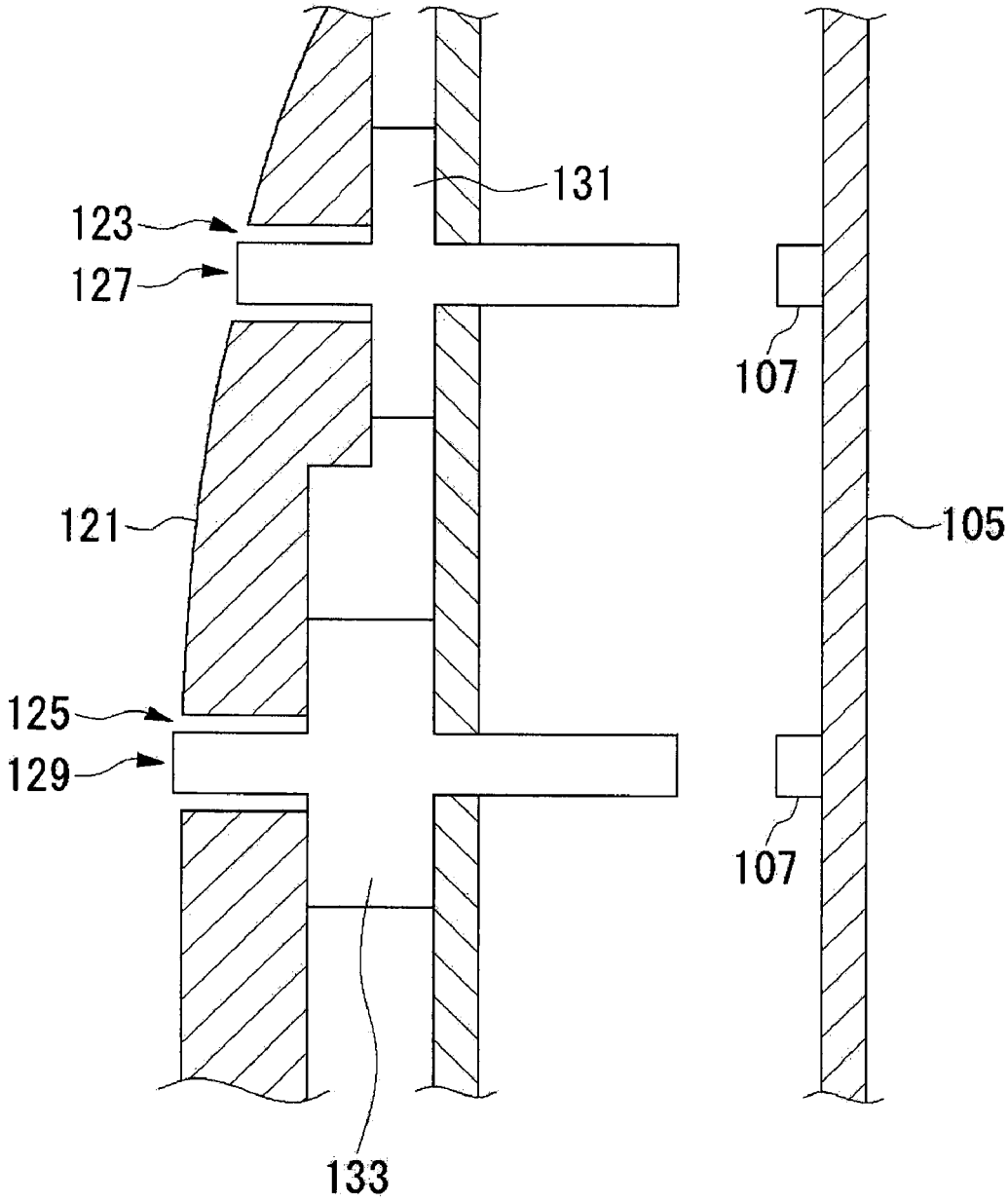
FIG. 8 PRIOR ART
FIG. 8 is a sectional view of a prior-art LED apparatus.

Next, FIG. 6 shows the third embodiment of the invention. In FIG. 6, identical reference numerals are assigned to the same constituents as in FIG. 1, and these constituents shall be omitted from description.

Also in this embodiment, each of the substrate-side protrusions 27 of light guide plates 9 has a sectional shape which becomes smaller toward a substrate 7. However, whereas the substrate-side protrusion 27 in FIG. 1 becomes finer in stages, the substrate-side protrusion 27 in this embodiment has a taper portion 91, which becomes finer continuously. The taper portion 91 has a first taper portion 911 and a second taper portion 913. Both the first taper portion 911 and the second taper portion 913 are parts of the taper portion 911, and the second taper portion 913 is the part nearer to the distal end side of the taper portion 91 than the first taper portion 911. Besides, sectional shapes become smaller in the order of a base portion 90, the first taper portion 911 and the second taper portion 913.

Meanwhile, a keeper plate 11 is provided with holding holes 93 and 95, the sizes of which differ in accordance with the arrangements of the LED light guide plates 9. The sectional dimension of the holding hole 95 is smaller than that of the holding hole 93. Besides, the sectional dimension of the holding hole 93 is smaller than that of the base portion 90, and it is larger than that of the second taper portion 913. Also, the sectional dimension of the holding hole 95 is smaller than that of the first taper portion 911. Thus, the first taper portion 911 is fitted into the holding hole 93, and the second taper portion 913 is fitted into the holding hole 95. Besides, the LED light guide plates 9 are higher in an LED window 15 than in an LED window 13. In this embodiment, after all, that position of the taper portion 90 where the sectional dimension agrees with that of the holding hole 93 lies in touch with the holding hole 93, and it corresponds to the first taper portion 911. Likewise, the position where the sectional dimensions agrees with that of the holding hole 95 lies in touch with the holding hole 95, and it corresponds to the second taper portion 913.

Incidentally, as already explained, the sectional dimensions in the above description are the dimensions of the holding holes, etc. in a direction which crosses the direction of inserting the light guide members into these holding holes, and they represent the relationships of sizes concerning the fitting engagements of the holding holes, etc. Besides, the holding hole 93 may well be larger than the first taper portion 911. In this case, the LED light guide plate 9 fits into the holding hole 93 until the end surface of the base portion 90 comes into touch with the keeper plate 11.

As thus far described, also in the third embodiment, notwithstanding that the light guide components are in the same shape, the positions of the light guide components in the light guide direction can be made different, the sorts of the components can be decreased, and curtailment in cost and reduction in the number of man-hour of the job are permitted.

Moreover, according to this embodiment, the portions to-be-held can be held at the desired positions of the taper portions, so that the versatility of setting the positions of the light-emitting-element light guide components can be increased.

Moreover, in the light emitting apparatus of this embodiment, each of the light-emitting-element light guide components is provided with the base portion, first taper portion and second taper portion, and the holding member is provided with the first holding hole the sectional dimension of which is smaller than that of the base portion and larger than that of the second taper portion, and the second holding hole the sectional dimension of which is smaller than that of the first taper portion. Thus, the positions of the light-emitting-element light guide components differ between on the occasions where the first taper portion fits into the first holding hole and where the second taper portion fits into the second holding hole. Accordingly, the positions of the light-emitting-element light guide components can be made different by the shapes of the holding holes.

Besides, also in this embodiment, the sectional shape of each portion to-be-held need not be an oblong. This sectional shape may well be, for example, a circle, an ellipse or any other polygon.

Although the preferred embodiments of the present invention thought out at the current point of time have been described above, it is to be understood that various modifications are possible to the embodiments, and it is intended that the appended claims cover all such modifications within the true spirit and scope of the invention.

INDUSTRIAL APPLICABILITY

As described above, a light emitting apparatus according to the present invention has the advantage that the sorts of components can be decreased, and it is useful for electronic equipments, etc.

The invention claimed is:

1. A light guiding apparatus characterized by comprising:

a substrate on which light emitting elements are mounted;

a housing which has a front surface having different distances from said substrate and having a plurality of windows corresponding to the light emitting elements, respectively;

light-emitting-element light guide components which are arranged at positions corresponding to the light emitting elements, and each of which includes a portion to-be-held in a sectional shape becoming smaller toward said substrate; and a holding member which has holding holes adapted to fit the portions to-be-held thereinto, sizes of said holding holes being set so as to differ in accordance with the distances from said substrate to said windows.

2. A light guiding apparatus as defined in claim 1, characterized in that each of said portions to-be-held includes a plurality of stages, and that each of said holding holes has a size corresponding to any of the plurality of stages.

3. A light guiding apparatus as defined in claim 2, characterized in that each of said light-emitting-element light guide components includes a base portion, a first stage portion and a second stage portion whose sectional shapes become smaller toward said substrate, that the first stage portion and the second stage portion are provided in said portion to-be-held, that said holding member has a first holding hole which has a sectional dimension smaller than that of the base portion and larger than that of said first stage portion, and a second holding hole which has a sectional dimension smaller than that of said first stage portion and larger than that of said second stage portion, and that said first stage portion fits into the first holding hole, while said second stage portion fits into the second holding hole.

4. A light guiding apparatus as defined in claim 1, characterized in that each of said portions to-be-held includes a taper portion, and that each of said holding holes has a shape in which it is held in touch with the taper portion when the light-emitting-element light guide component lies at a predetermined position.

5. A light guiding apparatus as defined in claim 4, characterized in that each of said light-emitting-element light guide components includes a base portion, a first taper portion and a second taper portion whose sectional shapes become smaller toward said substrate, that the first taper portion and the second taper portion are provided in said taper portion, that said holding member has a first holding hole which has a sectional dimension smaller than that of the base portion and larger than that of said second taper portion, and a second holding hole which has a sectional dimension smaller than that of said first taper portion, and that said first taper portion fits into the first holding hole, while said second taper portion fits into the second holding hole.

6. A light guiding apparatus as defined in claim 1, characterized in that light emission quantities of the light emitting elements are set so as to differ in accordance with the arrangements of said light-emitting-element light guide components in the light guide direction.

7. A light guiding apparatus as defined in claim 1, characterized in that the arrangements of the light emitting elements in the light guide direction are set so as to differ in accordance with the arrangements of said light-emitting-element light guide components in the light guide direction.

8. A light guiding apparatus as defined in claim 1, wherein said light-emitting-element light guide components have substantially the same shape.

* * * * *

UNITED STATES PATENT AND TRADEMARK OFFICE

CERTIFICATE OF CORRECTION

PATENT NO. : 7,619,211 B2
APPLICATION NO. : 10/578785
DATED : November 17, 2009
INVENTOR(S) : Aikawa et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 713 days.

Signed and Sealed this

Twenty-sixth Day of October, 2010

David J. Kappos

David J. Kappos
*Director of the United States Patent and Trademark Office*